United States Patent [19]

Wilson

[11] Patent Number: 4,927,022

[45] Date of Patent: May 22, 1990

[54] CORE TRAYS

[75] Inventor: John D. Wilson, Sandton, South Africa

[73] Assignee: Corstor (Proprietary) Limited, Johannesburg, South Africa

[21] Appl. No.: 322,905

[22] Filed: Mar. 14, 1989

[30] Foreign Application Priority Data

Jul. 28, 1986 [ZA] South Africa ..... 86/5995
Jul. 30, 1987 [ZA] South Africa ..... 87/5619

[51] Int. Cl.[5] ..... B65D 1/36

[52] U.S. Cl. ..... 206/443; 206/561; 206/506

[58] Field of Search ..... 206/443, 561, 506; 220/23.8, 23.6, 20, 22; 229/93, 913

[56] References Cited

U.S. PATENT DOCUMENTS

| | | | |
|---|---|---|---|
| 208,154 | 9/1878 | Cleveland | 206/443 |
| 2,551,012 | 5/1951 | Kenah | 206/443 |
| 3,581,929 | 6/1971 | Guenard | 206/443 |

FOREIGN PATENT DOCUMENTS

| | | | |
|---|---|---|---|
| 531345 | 10/1956 | Canada | 206/443 |
| 972302 | 8/1975 | Canada | 206/443 |
| 790368 | 5/1979 | South Africa . | |
| 800660 | 8/1980 | South Africa . | |
| 810059 | 1/1981 | South Africa . | |
| 820367 | 1/1982 | South Africa | 206/443 |
| 827926 | 10/1982 | South Africa | 206/443 |
| 836256 | 8/1983 | South Africa . | |

*Primary Examiner*—Paul T. Sewell
*Assistant Examiner*—Jacob K. Ackun, Jr.
*Attorney, Agent, or Firm*—McAulay Fisher Nissen & Goldberg

[57] ABSTRACT

A tray for cylindrical geological cores comprises a base plate of sheet material shaped to have therein longitudinally extending grooves which are each in the shape of a frustum of a triangle so that the cores can rest against the triangular sides. The tray has robust side members below support surfaces at its edges running parallel to the grooves whereby a second similar tray can be stacked thereon. At its ends the core tray has handles which serve as transverse re-inforcing means for the core. The shape of these handles is such that information about the cores in the tray can be recorded thereon. Drain holes are provide in the tray at the ends of the grooves to permit any water that might have entered the tray to escape.

28 Claims, 3 Drawing Sheets

CORE TRAYS

BACKGROUND TO THE INVENTION

Boreholes are drilled, especially in mining operations, to provide the engineer or geologist with information regarding the rock strata at depth. These cores are stored to provide a permanent record of the geology below the surface.

The core samples must be stored in such a way that they are readily accessible and identifiable as the geologists and/or engineers may have to refer to them from time to time. To this end, various types of core trays have been provided to store the core samples. The core trays have elongated grooves into which the core samples are received for storage. As these trays can be stacked one upon the other, they provide an efficient system for storing large quantities of cores.

Core trays were originally made from timber as exemplified by the items disclosed in South African Design Registrations Nos. 79/0368 (Malherbe), which has rectangular section grooves, and 80/0660 (Northern Cape Engineering), that has grooves the bases of which are hemi-cylindrical in shape. The core trays could also be vacuum moulded as shown in South African Patent No. 82/0367 (Proglo) and corresponding South Design Registration No. 81/0059 that also have grooves which are hemi-cylindrical in shape. Other core trays having similar grooves are described in South African Patents No. 82/7926 (Jones) and 83/6256 (Pieterse).

I have found that the above mentioned trays suffer from a major disadvantage. Because the grooves in the trays are hemi-cylindrical or have hemi-cylindrical bases they are very limited in that either the core is a close fit in the grooves which makes them difficult to remove or manoeuvre or they are not firmly held therein being able to move along the base thereof.

Further it is often difficult if not impossible to see the core samples in a stack of trays as the lower trays are covered by the trays thereabove.

SHORT STATEMENT OF INVENTION

According to an aspect of the invention I provide a core tray comprising a base plate of shaped sheet material having longitudinally extending grooves therein, the sides of which grooves are in transverse section flat and inclined to one another, support surfaces running parallel to the grooves whereon a second similar tray can be supported, and re-inforcing means provided at the ends of the grooves and extending transversely to the tray.

The grooves are each conveniently in the shape of a triangle or preferably a frustum of a triangle. The grooves are spaced apart by an amount at least equivalent to the diameter of the largest core sample that it is intended to be stored thereon. Thus conveniently the pitch of the grooves is about 50mm for the most usual size core samples.

The tray preferably has side members running parallel to the grooves, which side members are of heavier material than the base plate to brace the said support surfaces so as to be able to support a number of trays thereon. Each side member preferably has a flange which lies under the support surface. The side members preferably extend below the tray so as to be able to rest upon the shoulder of a similar core tray. The arrangement of these side members is such as to permit the overlying trays to slide one on the other and to interlock.

The reinforcing means preferably comprise end closure members which run along the ends of the tray (i.e. transversely to the direction of the grooves) and are preferably secured to the underside of the grooves. A part of each end closure member conveniently comprises a handle to facilitate the manipulation of the tray.

A longitudinal rim preferably runs along the outer edge of each support surface.

An embodiment of the invention will now be described by way of example with reference to the accompanying drawings where proportions are exaggerated to show the thickness of the sheet metal parts.

SHORT DESCRIPTION OF DRAWINGS

FIG. 1 is a perspective exploded view of a tray of the invention without any core samples thereon, FIG. 2 is a detail transverse section along line 2—2 of FIG. 1 with core samples contained on the tray, FIG. 3 is an end view of the tray without core samples thereon, FIG. 4 is a longitudinal section through the tray, FIG. 5 is a detail section on line 5—5 of FIG. 4, and FIG. 6 is a detail section on line 6—6 of FIG. 2 (but not showing the core samples).

DESCRIPTION OF PREFERRED EMBODIMENT

Figure 1:
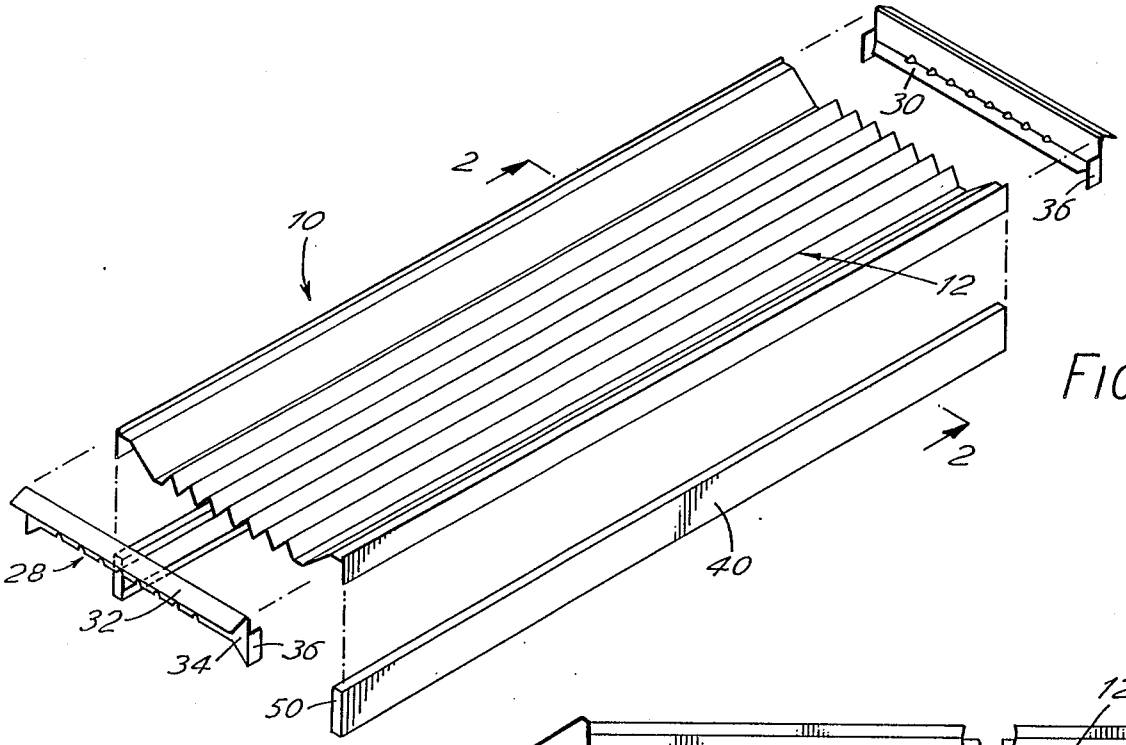
Figure 4:
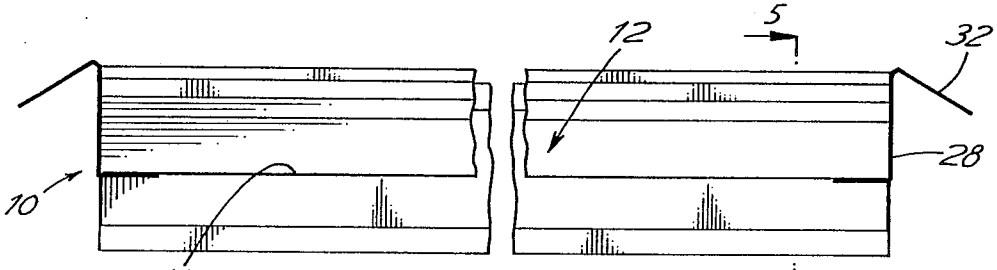
Figure 2:
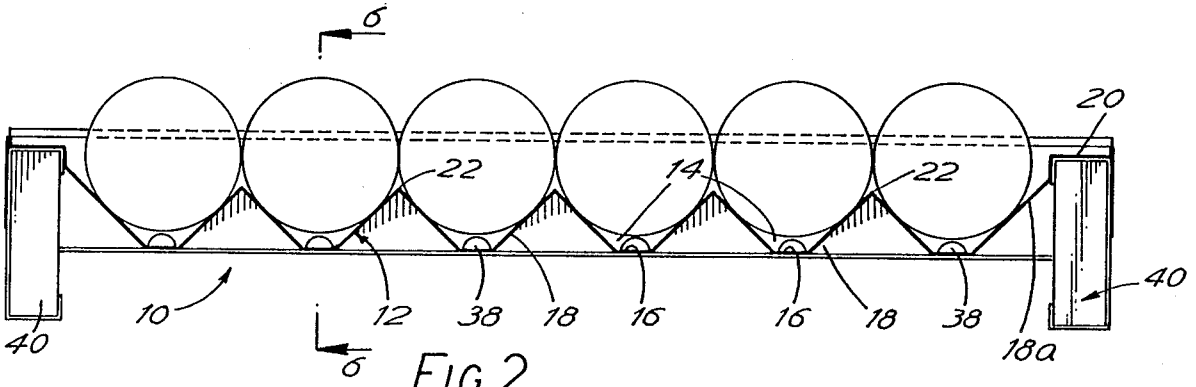
Figure 3:
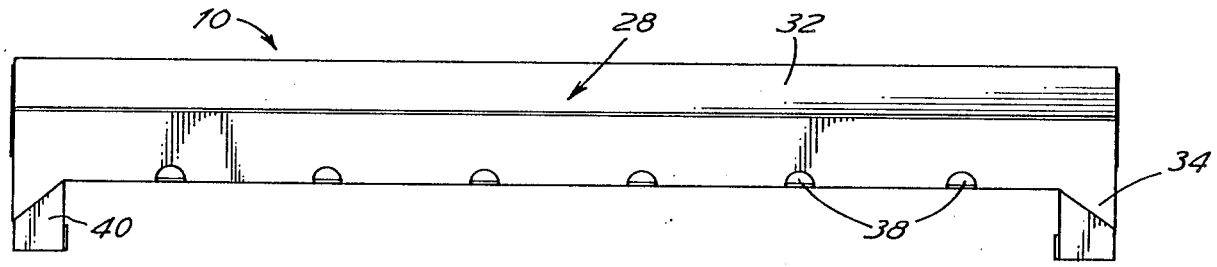
Figure 5:
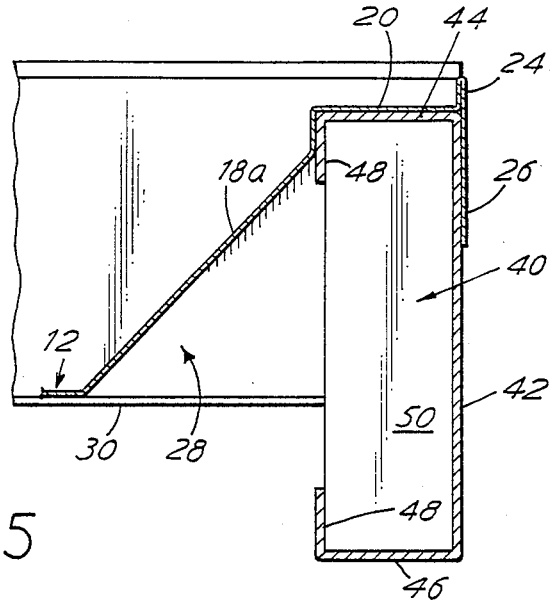

Referring now to the drawings, there is shown a core tray 10 of the invention. The core tray 10 comprises a base plate 12 formed e.g. by pressing a galvanised iron sheet. The plate 12 has formed therein a number of parallel, identical, longitudinally extending grooves 14 that are each in the shape of a frustum of a right angled isosceles triangle. The base 16 of each groove 14 is horizontal and the sides 18 are straight and are inclined at 45° to the horizontal (i.e. the planes within which the tray 10 lies) and at 90° to one another. The outer sides **18*a* of the outer two grooves 14 are approximately twice the length of the other sides 18. These sides 18*a* merge respectively at their upper ends into horizontal support surfaces or shoulders 20 (most clearly shown in FIG. 5) which are located at a level higher than the joins 22 of the sides 18 of adjacent grooves 14. A vertical rim 24 is provided running along the outer side of each shoulder 20 and this leads into a short skirt 26**.

Figure 6:
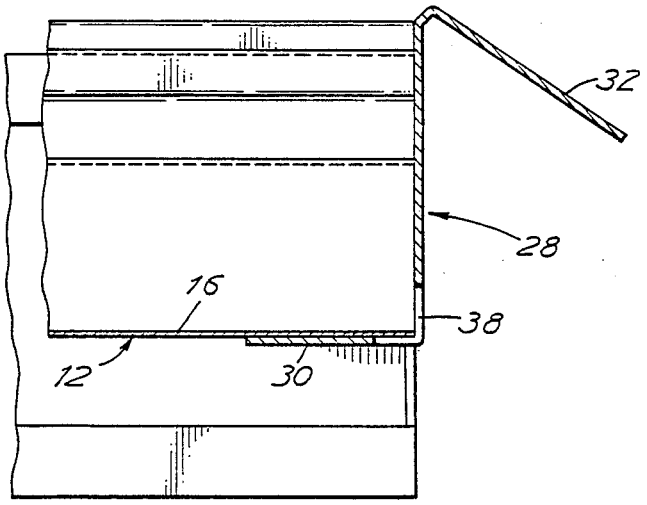

A pair of transversely extending end members 28 are provided at each end of the base plate 12. The end members 28 are each of sheet metal with an inwardly directed support flange 30 (but seen in FIG. 6) that lies under and is spot welded to the bases 16 of the grooves 14. The end members 28 extend to slightly above the level of the shoulders 20 and are there bent outwardly and downwardly at 45° to the horizontal to form handles 32 which facilitate handling of the tray 10. Each handle 32 is straight and flat so that relevant information about the cores contained on the tray 10 may be written on or attached to it. The support flange 30 is slightly less long than the end member 28 and beyond the support flange 30, the end member 28 has a leg 34 which carries at its edge a vertical inwardly directed flange 36.

Semi-circular drainage holes 38 are provided in the end member 28 and the flange 30 in alignment with the bases 16 of the grooves 14 to facilitate drainage of water from the grooves 14.

The length of the base plate 12 is such that the end members 28 are spaced apart by one meter (to about the nearest millemeter) apart.

A pair of longitudinally extending side members 40 are provided for the tray 10. The side members 40 are formed in a rectangular "C" shape from a heavier metal sheet than the base plate 12. Each side member 40 has an outer web 42 (best seen in FIG. 5) with upper and lower substantially identical inwardly directed flanges 44 and 46 each having a vertical end rim 48. An end closure plate 50 is provided at each end of each side member 26. The upper flange 44 lies against the shoulder 20 and the web 42 lies against the skirt 26, these parts being spot-welded together. The side members 40 provide bracing for the support surfaces 20. The side member 40 extends below the bases 16 of the grooves 14.

In use, core samples (indicated at 52) are placed in the grooves 14. Because the core samples 52 are of cylindrical shape and the grooves 14 are each in the shape of the frustum of a triangle with straight sides, the core samples 52 are accurately and firmly located with the centre of the core located on the central axis of the frustum.

A second tray 10 is now placed on the first mentioned tray with the lower flanges 46 of the side members 40 resting upon the support surfaces or shoulders 20. Because of the height of the side members 40, the bases 16 of the grooves 14 of the upper tray will be spaced above the upper portion of the core samples 52 in the lower tray and will not touch these. A stack of core trays can thus be formed in this way.

It will be seen too that at least the upper portions of the ends of the core samples 52 are visible even when a stack of core trays has been arranged one above the other providing for easy identification of the core. In addition because of the shape of the grooves 14, the amount of each core sample that can be seen from above is improved as compared to known core trays which facilitates recording of geological data relating thereto. Furthermore this shape has the effect that the core samples can be easily removed from the tray. Notwithstanding the foregoing, the core trays 10 provide compact storage units which can be compactly, economically and securely stored one above the other.

I have found that the side members 40 are sufficiently robust to be able to support thereabove a large number of core trays containing core samples. Thus a stack of up to forty trays has been conveniently produced and used. Thus as a core trays above described to received 75mm diameter cores can contain, say, four meters of core samples and a core tray as above described to receive 30mm diameter core samples could house ten meters of core samples, the stack of core trays could house from one hundred and sixty to four hundred meters of core samples depending upon the diameter of core samples to be received in the core trays. I have further found that the end members 28 provide re-inforcing means to prevent the base plate 12 bending about its longitudinal axis and the side members 40 prevent bending about a transverse axis. Thus the core tray 10 is adequately rigid about axes at right angles to one another. Because relevant information may be provided on each handle 32, it is relatively easy to identify and to locate any particular core sample 52 in a stack.

As the core tray comprises galvanised iron, it is less likely to corrode and will therefore provide a long life storage unit for core samples. Water can drain though the drainage holes 38. To this end, the stack of core trays are preferably arranged on a slightly inclined surface to encourage water to drain away through these drainage holes.

Because the handles 32 project outwardly, these tend to protect core samples in the tray below against weathering and ingress of water. To cores in the top tray of the stack may be protected by an empty tray being placed thereon.

Furthermore the core tray is relatively light and even with cores 52 thereon may conveniently be manhandled. The core tray is relatively inexpensive to manufacture.

As the end members 28 are a meter apart the core tray serves to facilitate meter marking and logging of the core samples.

The invention is not limited to the precise constructional details hereinbefore described and illustrated in the drawings. For example the core trays could comprise any suitable sheet material e.g. stainless steel or plastics material.

The end members may be slightly raised above the level of the shoulders to hold a stacked tray on the undertray against longitudinal movement relative thereto. The pitch of the grooves may differ depending upon the diameters of the core samples being stacked. Other dimensions vary as desired. Part only of the handles may be shaped to receive written information thereon.

I claim:

1. A core tray for supporting cores, comprising:

(a) a base plate of shaped sheet planar material having longitudinally extending grooves therein, the sides of which grooves are in transverse section flat and inclined to one another, the cores being supported solely by said sides, (b) support surfaces running parallel to the grooves whereon a second similar tray can be supported, and (c) re-inforcing means provided at the ends of the grooves and extending transversely to the tray.

2. A core tray as claimed in claim 1 wherein the grooves are each in the shape of a triangle.

3. A core tray as claimed in claim 1 wherein the grooves are each in the shape of the frustum of a triangle.

4. A core tray as claimed in claim 2 wherein the triangle is an isosceles triangle.

5. A core tray as claimed in claim 3 wherein the triangle is an isosceles triangle.

6. A core tray as claimed in claim 4 wherein the triangle is a right angled isosceles triangle.

7. A core tray as claimed in claim 5 wherein the triangle is a right angled isosceles triangle.

8. A core tray as claimed in claim 1 further comprising side members running parallel to the grooves, which side members are of heavier material than the base plate to brace the said support surfaces so as to be able to support a number of trays thereon.

9. A core tray as claimed in claim 8 wherein each side member has a flange which lies under the support surface.

10. A core tray as claimed in claim 1 in which the sides of adjacent grooves meet at a level lower than the level of the said support surfaces.

11. A core tray as claimed in claim 1 wherein the re-inforcing means comprise end closure members which run along the ends of the tray.

12. A core tray as claimed in claim 1 wherein the sheet material comprises metal sheet.

13. A core tray comprising:

(a) a base plate of shaped sheet material having longitudinally extending grooves, said grooves having a base and sides extending therefrom on which sides cores are supported, the sides of said grooves in transverse section are substantially flat and inclined to one another, the centres of the grooves being spaced apart by an amount at least equivalent to the diameter of the largest core sample that it is intended should be stored thereon, (b) support surfaces running parallel to the grooves whereon a second similar tray can be supported, and (c) re-inforcing means provided at the ends of the grooves and extending transversely to the tray whereby said base is of a size such that the largest extent of the base is less than the diameter of the core to be carried in the grooves for support of the core solely by said sides and above the bottom of said grooves.

14. The core tray according to claim 13, wherein said longitudinally extending grooves are located at a pitch of about 50 mm.

15. A core tray according to claim 13, including:

(d) side members each in the shape of a rectangular "C" running parallel to said grooves, said side members being of heavier material than said base plate to brace said support surfaces so as to be able to support a number of trays thereon.

16. A core tray according to claim 13, wherein:

said reinforcing means are in the form of end closure members which run along the ends of the tray and are provided at the ends of said grooves, and are secured to the undersides of said grooves.

17. A core tray as claimed in claim 13, including drain holes at at least one end of said grooves.

18. A core tray as claimed in claim 13, wherein said base plate is of shaped sheet galvanized iron.

19. A core tray as claimed in claim 13, wherein said reinforcing means are in the form of end closure members which run along the ends of the tray at the ends of the grooves and extend transversely to the tray; and a part of each said end closure member comprises a handle to facilitate the manipulation of the tray and at least a portion of said handle is flat and straight so that information may be written thereon.

20. A core stray as claimed in claim 13, having a drain hole at an end of at least one of said grooves.

21. The combination of a core tray with a plurality of cores carried thereby, the core tray comprising:

(a) a base plate of shaped sheet material having longitudinally extending grooves therein, said grooves each having a base and sides extending therefrom on which sides the cores are supported and which grooves are in transverse section substantially flat and inclined to one another, (b) support surfaces running parallel to the grooves whereon a second similar tray can be supported, and (c) re-inforcing means in the form of end closure members which run along the ends of the tray provided at the ends of the grooves and extending transversely to the tray, a part of each said end closure member comprising a handle to facilitate the manipulation of the tray and at least a portion of the said handle is flat and straight so that information may be written thereon, and the cores being received within the grooves and being supported on the said sides of the grooves, whereby said base is of a size such that the largest extent of said base is less than the diameter of the cores to be carried in the grooves for support of the cores solely by said sides and above the bottom of said grooves.

22. A core tray comprising a base plate of shaped sheet material having longitudinally extending grooves therein, the grooves being defined by a base and longitudinally extending sides extending from said base, said sides being substantially flat and inclined to one another, support surfaces running parallel to the grooves whereon a second similar tray can be supported, and re-inforcing means provided at the ends of the grooves and extending transversely to the tray whereby the base is of a size such that the diameter of the core is greater than the largest extent of the base for support of the cores solely by said sides and above the bottom of said grooves.

23. A core tray for supporting geological cores, comprising:

(a) a base plate of shaped sheet planar material having longitudinally extending grooves therein, said grooves each having a base and sides extending from said base, said sides being in transverse section flat and inclined to one another;

(b) support surfaces running parallel to said grooves whereon a second similar tray can be supported; and (c) re-inforcing means provided at the ends of said grooves and extending transversely to the tray, whereby said base is of a size such that the diameter of the geological core is greater than the largest extent of said base for support of the core so that the core is carried solely by said sides.

24. A core tray as claimed in claim 23, wherein the grooves are each substantially in the shape of a triangle.

25. A core tray as claimed in claim 23, wherein the side members extend below the tray so as to be able to rest upon the shoulder of a similar core tray therebelow.

26. A core tray, comprising:

a base plate of shaped sheet material having a base and sides extending therefrom on which sides cores are supported and which sides in transverse section are substantially flat and inclined to one another, and said base being in flat transverse section and being of a size such that the diameter of each of the cores is greater than the largest extent of said base such that support of each of the cores is solely by said sides, the cores not contacting said base.

27. A core tray for geological cores, comprising:

a base plate of shaped sheet material having longitudinally extending grooves therein, said grooves having sides on which the cores are supported and which are in transverse section substantially flat and inclined to one another, whereby said grooves in transverse section are of a size such that the diameter of the cores is larger than the largest extent between the sides below the cores for support of each of the cores solely by said sides and above the bottom of said grooves.

28. The combination of a core tray with a plurality of geological cores carried thereby, the core tray comprising:

(a) a base plate of shaped sheet material having longitudinally extending grooves therein, said grooves having a base and sides extending therefrom, said base being flat in transverse section, and said sides being substantially flat and inclined to one another in transverse section;

(b) means associated with said grooves for supporting a second similar tray; and the cores being received within the grooves and said base being of a size such that the largest extent of said base is less than the diameter of the cores so that each of said cores is supported by said sides.

* * * * *